US012440740B1

(12) United States Patent
Jones

(10) Patent No.: US 12,440,740 B1
(45) Date of Patent: Oct. 14, 2025

(54) HEIGHT ADJUSTABLE OBSTACLE WALL

(71) Applicant: Justin Jones, Pinehurst, NC (US)

(72) Inventor: Justin Jones, Pinehurst, NC (US)

( * ) Notice: Subject to any disclaimer, the term of this patent is extended or adjusted under 35 U.S.C. 154(b) by 91 days.

(21) Appl. No.: 18/502,277

(22) Filed: Nov. 6, 2023

Related U.S. Application Data

(60) Provisional application No. 63/386,904, filed on Dec. 11, 2022, provisional application No. 63/382,679, filed on Nov. 7, 2022.

(51) Int. Cl.
*A63B 69/00* (2006.01)

(52) U.S. Cl.
CPC .... *A63B 69/0048* (2013.01); *A63B 2225/093* (2013.01)

(58) Field of Classification Search
CPC ..... A63B 69/0048; A63B 69/0097; A63B 71/0036; A63B 71/03; A63B 2071/025; A63B 2210/00; A63B 2210/50; A63B 2214/00; A63B 2225/093
See application file for complete search history.

(56) References Cited

U.S. PATENT DOCUMENTS 4,093,218 A * 6/1978 Burchers ..... A63B 69/38 473/435
4,659,075 A * 4/1987 Wilkinson ..... A63B 22/0023 482/52
6,083,142 A * 7/2000 Wilson ..... A63B 69/0048 482/37
10,072,411 B1 9/2018 Moran et al.
10,543,413 B2 1/2020 Nelson et al.
10,557,262 B2 2/2020 Moran et al.
2008/0293548 A1* 11/2008 Moy ..... A63B 69/0048 482/36
2008/0300111 A1* 12/2008 Meissner ..... A63B 69/0048 482/36
2017/0197132 A1* 7/2017 Bowers ..... A63B 69/0048
2018/0028852 A1* 2/2018 Beaver ..... A63B 71/0036
2019/0009157 A1* 1/2019 Sudeith ..... A63B 71/0054
2020/0023257 A1* 1/2020 Speed ..... A63B 69/0048
2020/0171369 A1* 6/2020 Sudeith ..... A63B 69/0048
2020/0222778 A1* 7/2020 Smith ..... A63B 71/023
2020/0246671 A1* 8/2020 Brewer ..... A63B 22/04
2021/0101061 A1* 4/2021 Pell ..... A63B 69/0048
2021/0154548 A1* 5/2021 Sudeith ..... A63B 23/1218
2021/0245026 A1* 8/2021 Sudeith ..... A63B 69/0048
(Continued)

FOREIGN PATENT DOCUMENTS

AT 516246 A1 * 3/2016 ..... A63B 69/0048
CN 108635796 A * 10/2018 ..... A63B 69/0048
CN 112973064 A * 6/2021 ..... A63B 69/0048
(Continued)

*Primary Examiner* — Gary D Urbiel Goldner
(74) *Attorney, Agent, or Firm* — Standley Law Group LLP; Adam J. Smith; Bryan P. Finneran

(57) ABSTRACT

An adjustable obstacle wall apparatus and related systems and methods are disclosed. The adjustable obstacle wall includes a base with a first portion for resting on a ground surface and columns which extend upward from the first portion. A wall portion includes one or more wall panels connected to outer framework members which are adjustable along the columns. The wall portion may be moved in a sliding fashion to adjust the height of the wall portion relative to the ground surface.

19 Claims, 12 Drawing Sheets

(56) References Cited

U.S. PATENT DOCUMENTS

| | | | | |
|---|---|---|---|---|
| 2021/0275888 | A1* | 9/2021 | Speed | A63B 69/0048 |
| 2022/0016505 | A1* | 1/2022 | Sweeney | A63B 69/0048 |

FOREIGN PATENT DOCUMENTS

| | | | | | |
|---|---|---|---|---|---|
| DE | 20210301 | U1 * | 9/2002 | | A63B 69/0048 |
| DE | 102011084835 | A1 * | 4/2013 | | A63B 17/00 |
| DE | 202018004030 | U1 * | 9/2018 | | A63B 22/0235 |
| DE | 102017008020 | A1 * | 2/2019 | | A63B 69/0048 |
| KR | 20190073313 | A * | 6/2019 | | A63B 69/0048 |
| KR | 20210120392 | A * | 10/2021 | | A63B 69/0048 |
| KR | 102633082 | B1 * | 2/2024 | | A63B 69/0048 |
| WO | WO-2022108991 | A2 * | 5/2022 | | A63B 69/0048 |

* cited by examiner

HEIGHT ADJUSTABLE OBSTACLE WALL

CROSS-REFERENCE TO RELATED APPLICATIONS

This application claims the benefit of U.S. provisional application Ser. No. 63/382,679 filed Nov. 7, 2022 and U.S. provisional application Ser. No. 63/386,904 filed Dec. 11, 2022, the disclosures of which are hereby incorporated by reference as if fully restated herein.

TECHNICAL FIELD

Exemplary embodiments relate generally to a height adjustable obstacle wall, such as for physical fitness training, and related systems and methods.

BACKGROUND AND SUMMARY OF THE INVENTION

Obstacles courses have long been a staple of certain training regimes, such as physical fitness training for military, police and/or other law enforcement, fire, emergency, and/or other first responder personal, certain races and/or physical fitness challenges, personal fitness training (e.g., at public parks and/or jogging trails), and the like. Often, such obstacle courses include one or more fixed obstacle walls located about an outdoor track or areas which a participant is intended to scale. Building and maintaining such an obstacle course, however, is difficult and generally occupies a large area. At least in part because of this, such obstacle courses are typically only available to large organizations with large amounts of available land and other resources (e.g., funding) for installation and maintenance. Furthermore, being fixed in nature, it is difficult to revise or update the obstacle course or individual obstacles over time. What is needed is a device which provides an obstacle course type training experience without the need for a full obstacle course.

A height adjustable obstacle wall is provided. The height adjustable obstacle wall (hereinafter also the "wall" or the "device") may provide an obstacle course type training experience without the need for a full obstacle course. The adjustability of the wall may allow the height adjustable obstacle wall to fill the role of several conventional, fixed, obstacle course type walls.

The wall may include a base portion, portions of which may be fixed and portions of which may be foldable, such as for relatively compact storage and/or transportation. Columns may extend vertically upward from the base portion. A wall portion may comprise outer framework members which preferably fit within the columns to provide sliding, telescoping movement of the wall portion.

The wall may include a fixed lateral support, which may form part of the base. The fixed, lateral support may extend laterally between the columns, preferably at an upper portion thereof. An adjustable wall portion may include wall panel (s) attached to the moveable portions of the columns. The wall portion may include additional lateral supports, such as for stability and/or mounting the wall panel(s). Preferably, the wall portion is provided between front and rear portions of the lateral support. Apertures may be provided along at least the movable portions of the columns which accept pins or other fasteners which are extendable through the lateral support to secure the wall portion at various heights. Apertures may be provided at a lower portion of the wall portion which accept handles that provide grip points for adjusting the height of the wall portion.

Struts may be removably secured between the base and the columns to increase stability when the wall is in an unfolded, use configuration. Preferably, the length of the struts is adjustable and/or multiple attachment points for the struts are provided, such as to provide leveling of the device on relatively uneven surfaces (e.g., outdoors, grassy areas). Attachment points may also be provided for securing the folded portions of the base to one another when the wall is in a folded, transportation/storage configuration. Wheels may be secured to, permanently or temporally, to the base, particularly when folded, for transportation/storage of the wall. A two-wheeled dolly or other, preferably two-wheeled hard cart may be attachable to a portion of the device, such as at a tow arm, which is preferably foldable or removable for compact storage. Thus, the device may be portable and configured for indoor/outdoor use.

Various accessories may be selectively attached to, and utilized with, the device. Such accessories may include, for example without limitation, a chin-up bar, a pivoting receiver for a barbell end, belt squat attachment, dip bar attachment, d-ring attachment, skid plate attachments to push the wall as a sled, a doorway and/or barrier for breaching, tunnel extension for crawling, other custom attachments requested by a customer, combinations thereof, or the like. In exemplary embodiments, the wall portion may comprise cut outs to accommodate the chin-up bar, which may comprise protrusions securable within the apertures of the columns. The pivoting receiver for the barbell end may be secured at an end of the base, such as by way of one or more locking pins.

The device may provide a portable, storable, height adjustable obstacle wall that facilitates a wide variety of training exercises and fitness experiences. Exercises may include, for example without limitation, climbing over the wall, moving underneath the partially or fully raised wall portion, use of the attachments (e.g., chin-up bar, barbell within receiver, weighted rope positioned around one or more of the base components and/or wall portion components), throwing objects at, over, or under the wall portion, combinations thereof, or the like. Alternatively, or additionally, the wall may be utilized for a barrier for shooting ranges, simulation of tactical training scenarios such as clearing a room, blast barrier mount, or other tactical training uses. Multiple people may utilize the wall at one time creating a circuit style training apparatus that may be used for large groups.

While manual adjustment is shown and/or discussed in many instances, motorized equipment may provide automated adjustment. For example, one or more linear actuators, pneumatics, or other motors may be provided at, within, or in association with the columns to provide the vertical adjustment. Gear, counterweights, threaded rods, motors, flexible lines, combinations thereof, or the like may be utilized. Such motorized equipment, where utilized, may be controlled remotely and/or locally.

Further features and advantages of the systems and methods disclosed herein, as well as the structure and operation of various aspects of the present disclosure, are described in detail below with reference to the accompanying figures.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Figure 1:
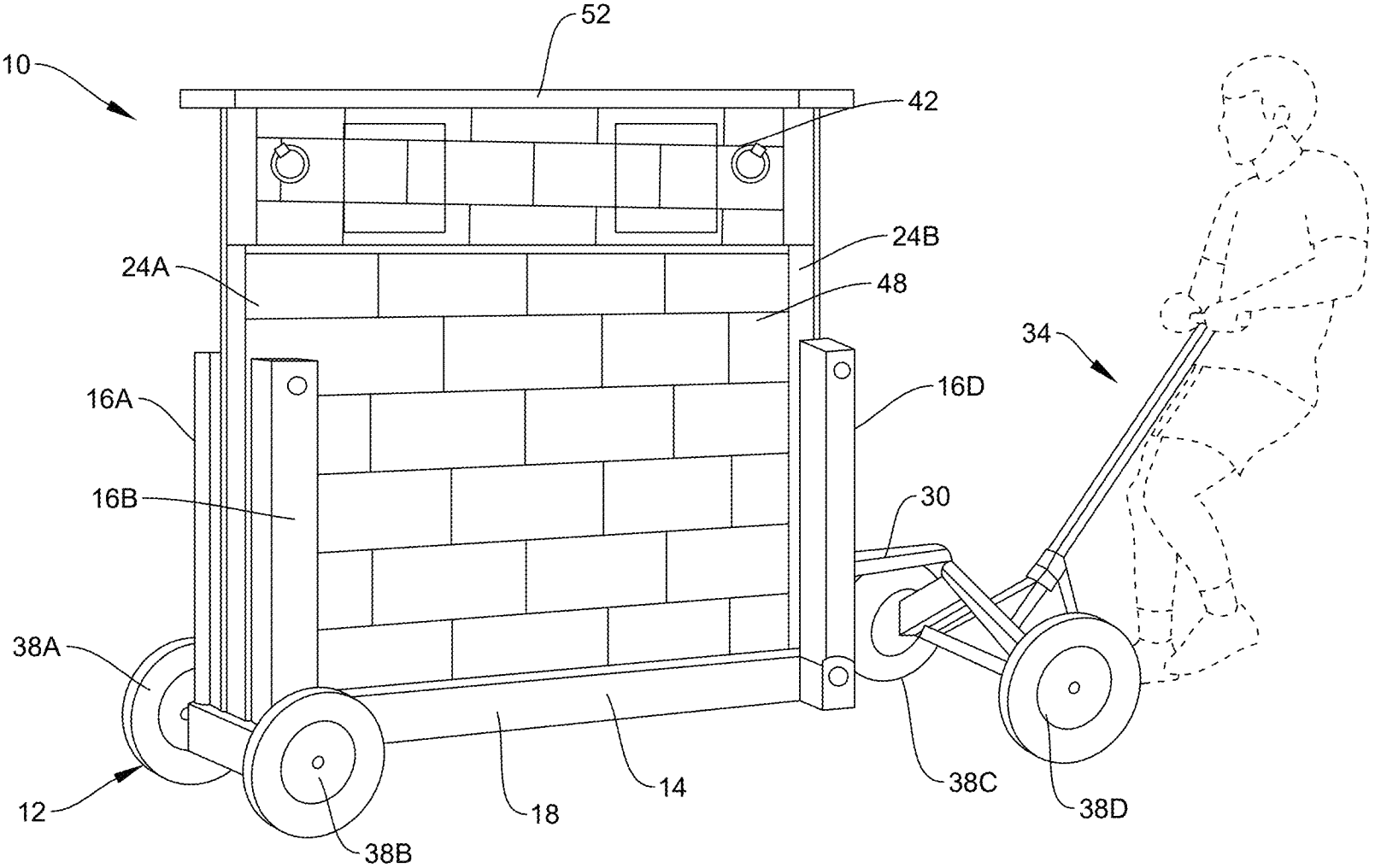
FIG. 1 is a perspective view of an exemplary height adjustable obstacle wall in an exemplary transportation configuration.
Figure 2:
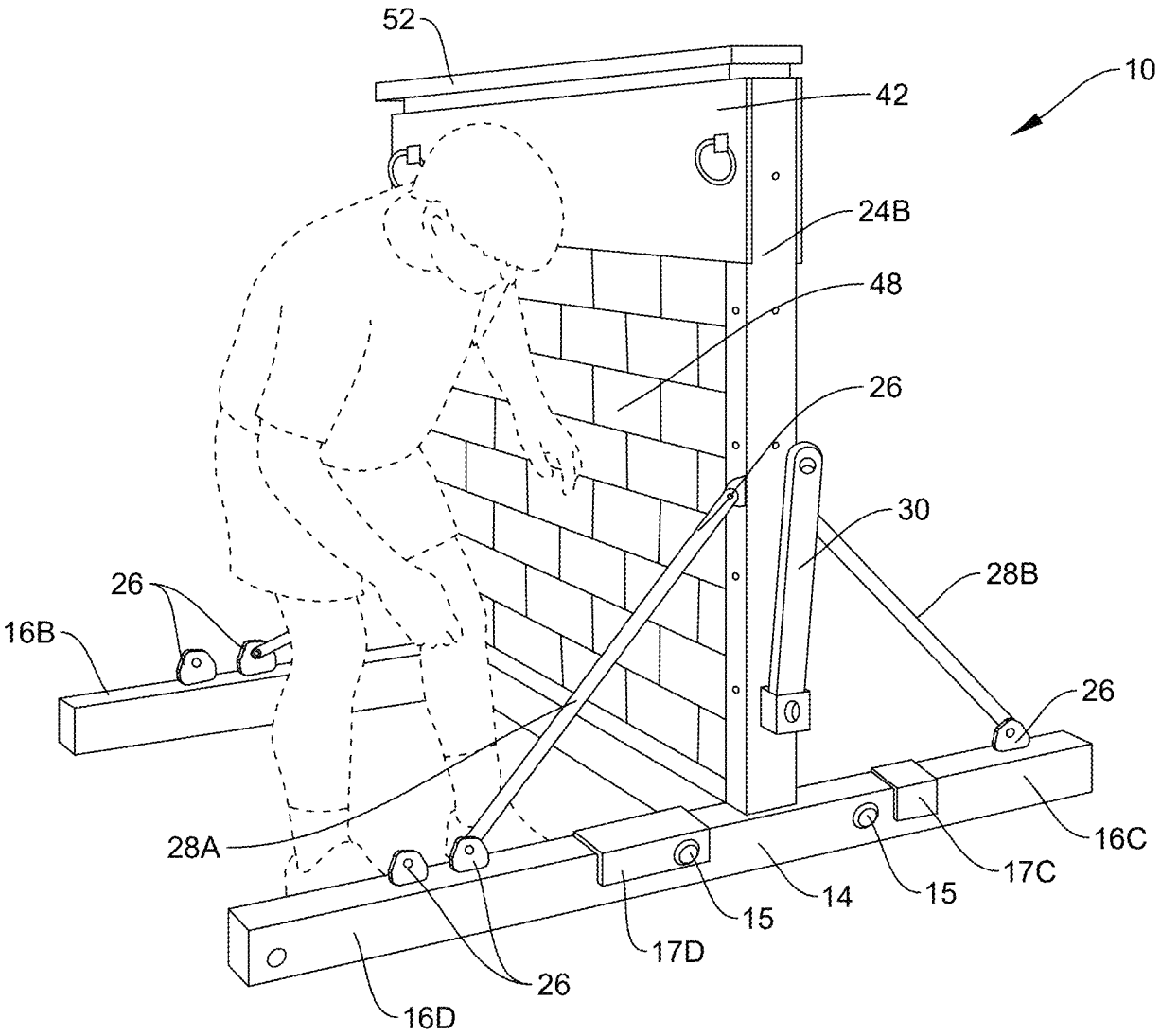
FIG. 2 is a perspective view of the height adjustable obstacle wall of FIG. 1 in an exemplary use configuration.
Figure 3:
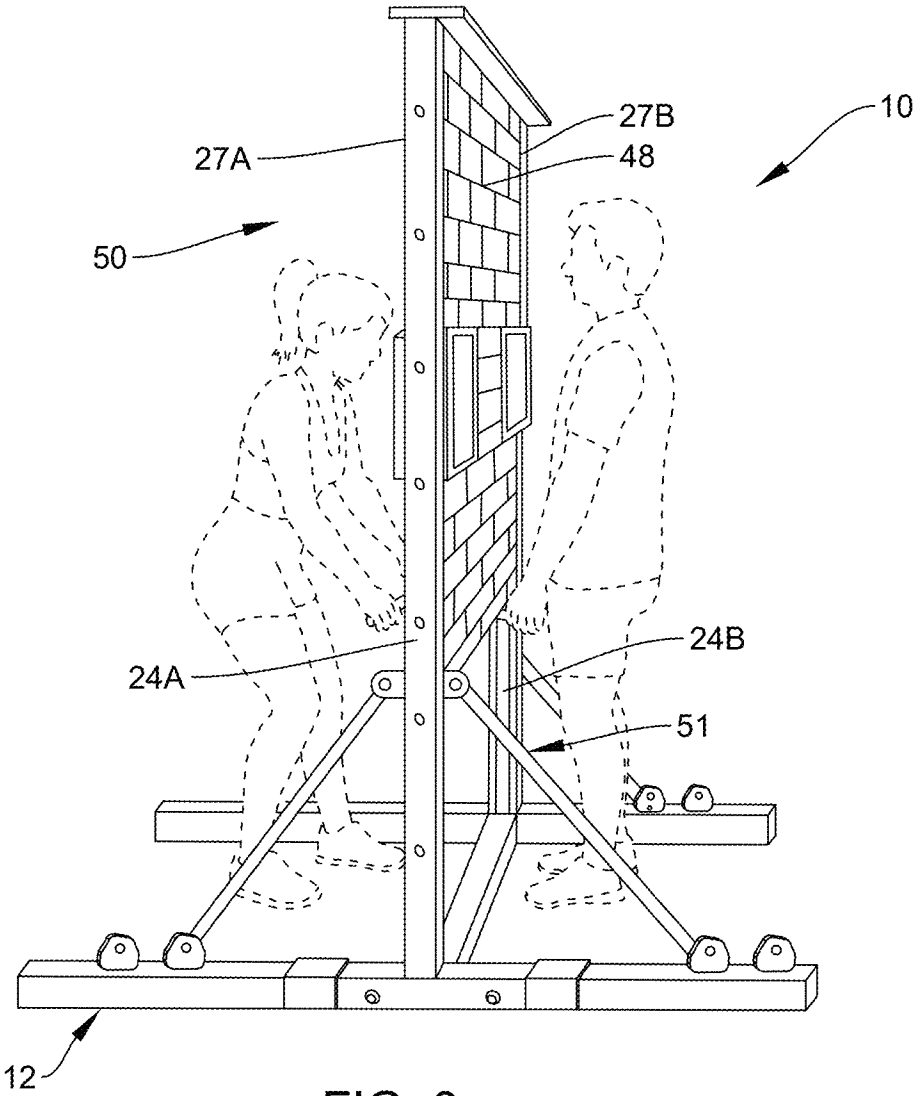
FIG. 3 is a perspective view of the height adjustable obstacle wall of FIG. 1 undergoing height adjustment of the wall portion.
Figure 4:
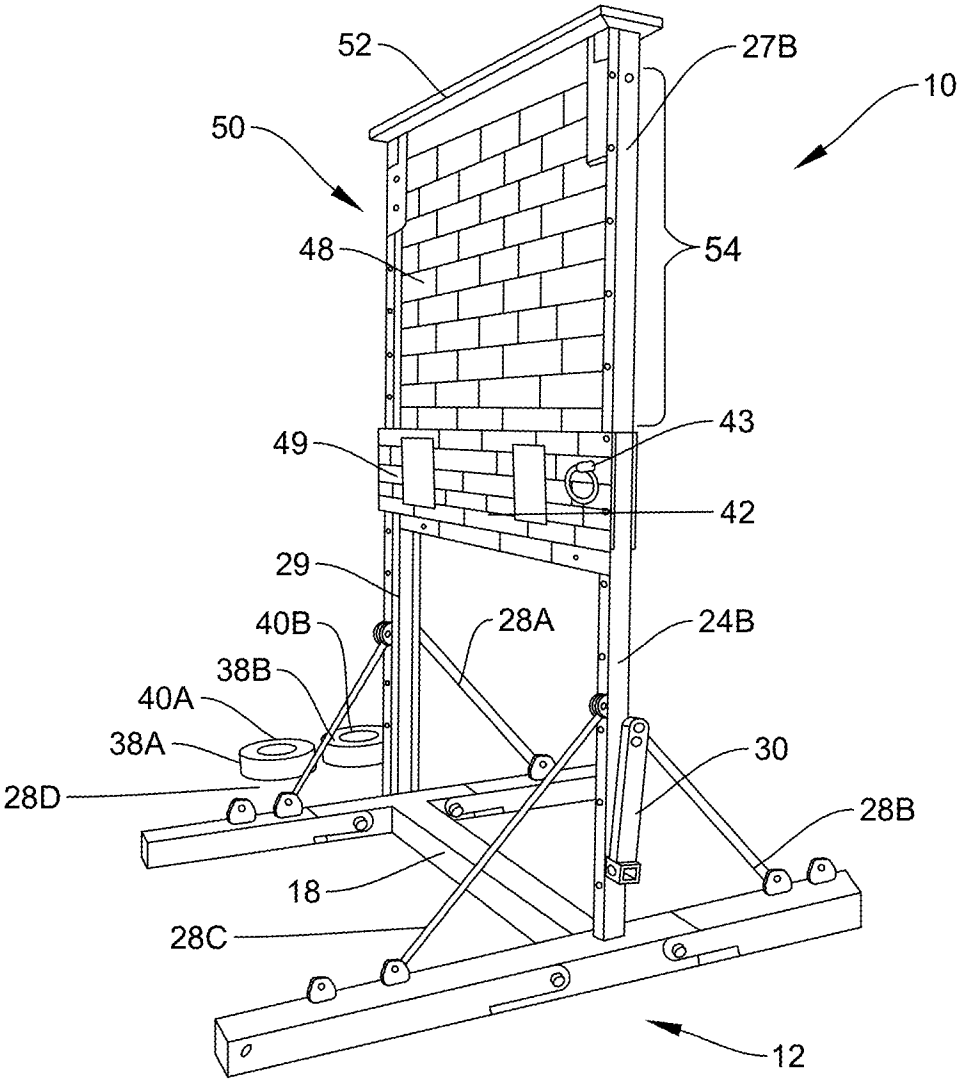
FIG. 4 is a perspective view of the height adjustable obstacle wall of FIG. 1 with the wall portion at an exemplary maximum height.

Various embodiments of the present invention will now be described in detail with reference to the accompanying drawings. In the following description, specific details such as detailed configuration and components are merely provided to assist the overall understanding of these embodiments of the present invention. Therefore, it should be apparent to those skilled in the art that various changes and modifications of the embodiments described herein can be made without departing from the scope and spirit of the present invention. In addition, descriptions of well-known functions and constructions are omitted for clarity and conciseness.

Embodiments of the invention are described herein with reference to illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

FIG. 1 through FIG. 11 illustrates an exemplary height adjustable obstacle wall (hereinafter also the "wall" or the "device") 10. The device 10 may comprise a base 12. Preferably, the base 12 is at least partially foldable, such as for transportation and/or storage. In exemplary embodiments, the base 12 forms a generally "H" shaped footprint when the base 12 is unfolded, such as when the device 10 is placed in a use configuration. The base 12 may comprise a fixed portion 14 and foldable arms 16. For example, the fixed portion 14 may comprise a lengthwise extending member 18 and widthwise extending members 20A, 20B located at either end thereof, such as forming at least part of the generally "H" shaped footprint. Foldable arms 16A, 16B, 16C, 16D may be connected to each end of the widthwise extending members 20A, 20B, such forming a remainder of the generally "H" shaped footprint.

In exemplary embodiments, without limitation, the foldable arms 16 are connected to the fixed portion 14 by way of brackets 17 and pin joints 15. This may permit the arms 16 to be folded upward for storage and/or transportation and/or folded downward (e.g., to ground surface) to increase stability. For example, without limitation, the foldable arms 16 may comprise, or be associated with, the brackets 17. The brackets 17 may be integrally formed with the foldable arms 16, welded, bonded, and/or fastened thereto. The brackets 17 may extend from the foldable arms 16. The brackets 17 may be secured to the fixed portion 14 by way of the pin joints 15, bolts, combinations thereof, or the like. Each of the foldable arms 16A-16D may have or be attached to a respective one of the brackets 17A-17D, each of which may be attached to a respective portion (preferably, end area) of the fixed portion 14, such as by way of an associated one of the pin joints 15A-15D or other fastener that allows folding movement of the foldable arms 16. The brackets 17 may provide sufficient clearance for folding the arms 16 about the fixed portions 14.

Alternatively, or additionally, the arms 16 may be removable and temporarily secured, such as by way of locking pins, friction fit, nesting arrangement, or the like.

Alternatively, or additionally, such folding movement may not be required. In such instances, the foldable arms 16 may not be required and the widthwise extending members 20A, 20B may extend further.

The base 12 may comprise square or rectangular tubing, though other types and kinds of materials and/or cross-sectional shapes may be utilized.

Columns 24 may extend in a generally vertical direction from the base 12. In exemplary embodiments, without limitation, a first and second column 24A, 24B are spaced apart from one another, such as at either side of the lengthwise extending member 18, and preferably at, or proximate to, where the lengthwise extending member 18 and widthwise extending members 20A, 20B meet, respectively. In exemplary embodiments, without limitation, each of the first and second columns 24 is fixed and forms part of the base 12 (e.g., fixed at and/or to one or both of the lengthwise extending member 18 and respective one of the widthwise extending members 20), and a wall portion 50 comprises outer framework members 27A, 27B, which are movable relative to the columns 24A, 24B, respectively. The columns 24 may form part of the base 12 of the wall 10. The outer framework members 27 may form part of the wall portion 50 of the wall 10. Preferably, each of the outer framework members 27 fit at least partially within an associated one of the columns 24 for movement, such as in a telescoping fashion. However, other arrangements and/or forms of movement may be utilized (e.g., side by side sliding). For example, without limitation, the outer framework members 27 may slide along an outside of the columns 24 in other exemplary embodiments. At least the columns 24 may comprise inward facing channels 29 for accommodating the wall panel(s) 48 affixed to the outer framework members 27.

The various components of the base 12 and/or wall portion 50 may be integrally formed, welded, bonded, fastened, combinations thereof, or the like.

Attachment points 26 may be provided at the base 12 (e.g., folding arms 16) and/or the columns 24. A first subset of the attachment points 26 may be provided for accepting the struts 28. Preferably, such attachment points 26 are provided in pairs to accept a portion of a respective strut 28 therebetween, such as when the wall 10 is in the unfolded/use configuration. A second subset of the attachment points 26 may be provided for attachment to one another, such as when the wall 10 is in the folded/transportation configuration.

In exemplary embodiments, without limitation, the attachment points 26 are provided at the each of the arms 16A, 16B, 16C, 16D and either side of each of the columns 24A, 24B so that four struts 28A, 28B, 28C, 28D may be provided. The struts 28 may connect the arms 16 to the columns 24, such as to provide enhanced stability. In exemplary embodiments, without limitation, the struts 28 are length adjustable, such as by way of internal threads and relative rotational movement by way of non-limiting example. Alternatively, or additionally, length adjustment may be provided by way of telescoping, frictional fit, spaced apertures and pins, combinations thereof, or the like. The struts 28 may be secured to the attachment points 26 by pins, screws, bolts, snap fit, friction fit, locking channel, combinations thereof, or the like.

When the device 10 is placed in the transportation/storage configuration, the struts 28 may be removed and the arms 16 folded and secured to the columns 24, such as by way of at least certain of the attachment points 26 (e.g., at the columns 24 and/or one another) and pins or other fasteners, for example. The struts 28 may be stored within the arms 16, in exemplary embodiments. When the device 10 is placed in the use configuration, the struts 28 may be installed to at least certain of the attachment points 26 (e.g., at columns 24 and arms 16) by way of the pins, for example. Lengths of the struts 28 may be adjusted, such as to accommodate a level or relatively uneven surface. Leveling feet may alternatively or additionally be utilized at various parts of the base 12.

The device 10 may comprise a hitch arm 30. Preferably, the hitch arm 30 is mounted to on an exterior facing portion of one of the columns 24. The hitch arm 30 may be mounted in a manner which permits folding, such as for folding up against the columns 24 when the device 10 is in the use configuration and/or storage configuration, and/or folding down to extend outward from the column 24 when the device 10 is in the transportation configuration. The hitch arm 30 may comprise a hitch receiver 32. A dolly or other hand cart 34 may be selectively attached to the hitch arm 30, such as by way of a hitch ball 36 and the hitch receiver 32.

The device 10 may be configured to removably accept wheels 38. Preferably, two wheels 38A, 38B are installable to the base 12 and two wheels 38C, 38D are provided at the hand cart 34. In exemplary embodiments, the two wheels 38A, 38B comprise blocks 40A, 40B which are receivable within end portions of the widthwise extending members 20A, 20B of the fixed portion 14, such as by nesting arrangement, which may be accessible when the arms 16 are folded. The two wheels 38C, 38D may be permanently installed to the hand cart 34, such as along with the hitch ball 36.

In exemplary embodiments, without limitation, to place the device 10 in a transportation configuration, the device 10 is tilted, such as tipped forward and backward about the lengthwise member 18, to install the wheels 38A, 38B on either side thereof. The hitch arm 30 is positioned for use by folding downward, such as to extend substantially (e.g., within 20%) perpendicular to a longitudinal axis of the associated one of the columns 24. The hand cart 34 may be subsequently attached to the hitch arm 30. Tilting the hand cart 34 may elevate the base 12 such that the device 10 is transportable by pushing the hand cart 34 and/or the device 10. This may allow relatively easy transportation of the device 10.

This may also constitute a storage configuration, though attachment of the wheels 38A, 38B and/or the hand cart 34 is not required.

While the wheels 38 are sometimes shown and/or described for single direction movement, the wheels 38 may be casters and/or otherwise configured for pivoting or other movements which allows the wall 10 to be pushed in various directions. In such cases, the hard cart 34, for example, is not necessarily required.

A lateral support 42 may extend between the columns 24. Preferably, the lateral support 42 is provided at an upper portion of the columns 24. In exemplary embodiments, without limitation, the lateral support 42 is attached to the columns 24 such that the lateral support 42 is fixed relative to, and/or forms part of, the base 12, such as while the wall portion 50 remains height adjustable. The lateral support 42 may comprise one or more forward members and/or panels 49A located at a first side of the columns 24 and one or more rear members and/or panels 49B located at a second side of the columns 24. The members and/or panels 49 may appear as additional wall panel(s), though such is not required.

Figure 8:
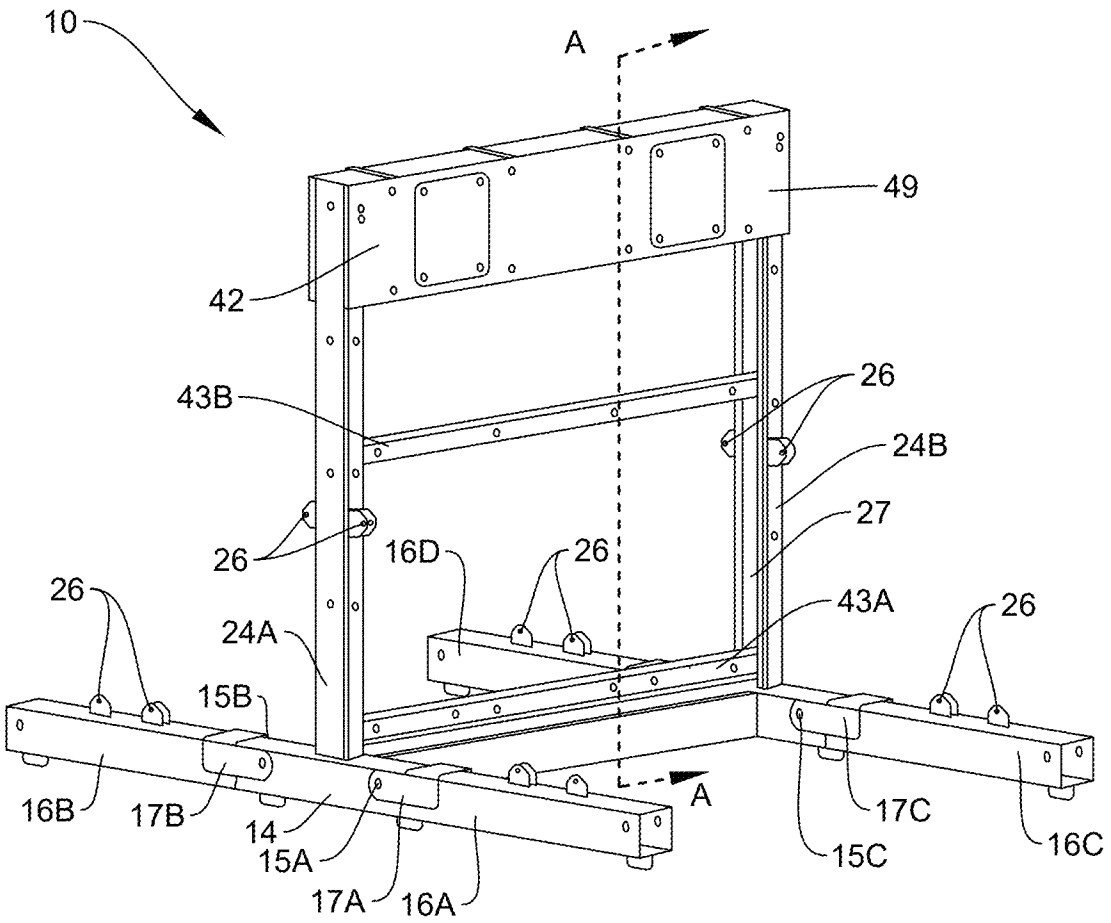
FIG. 8 is a perspective view of the height adjustable obstacle wall in the use configuration with certain components not illustrated.
Figure 9:
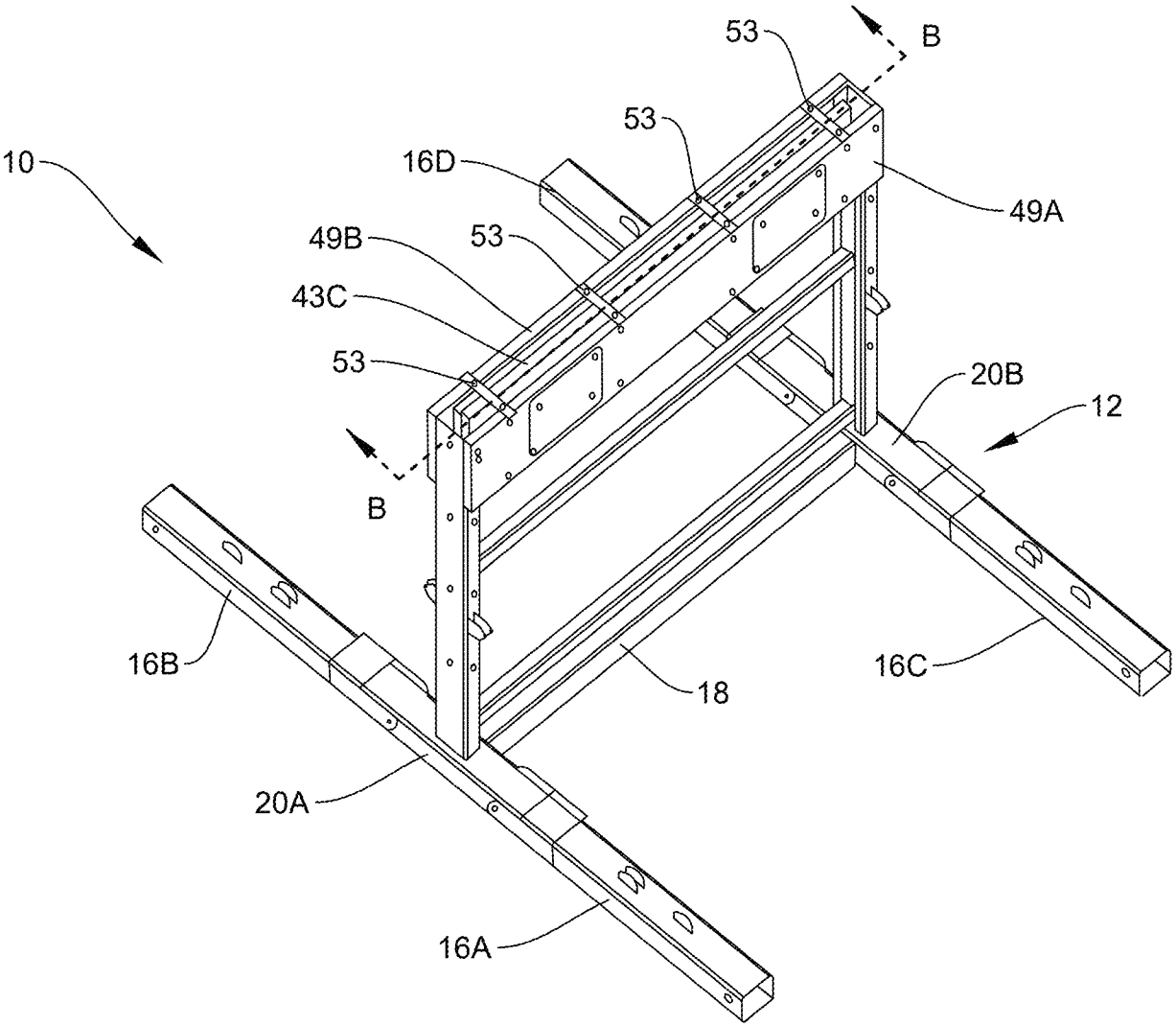
FIG. 9 is another perspective view of the height adjustable obstacle wall of FIG. 8.
Figure 10:
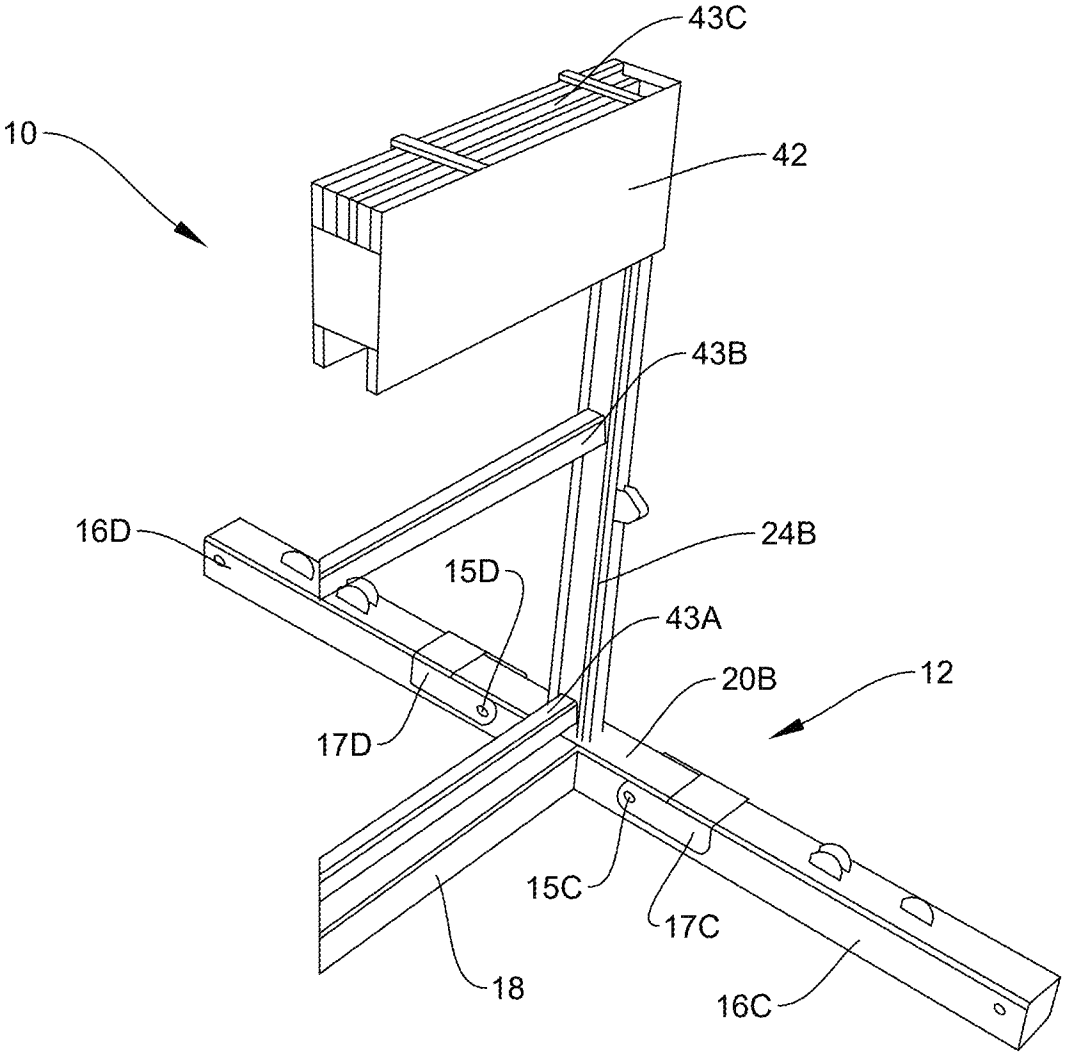
FIG. 10 is a perspective sectional view of the height adjustable obstacle wall of FIG. 8 taken along section line A-A.
Figure 11:
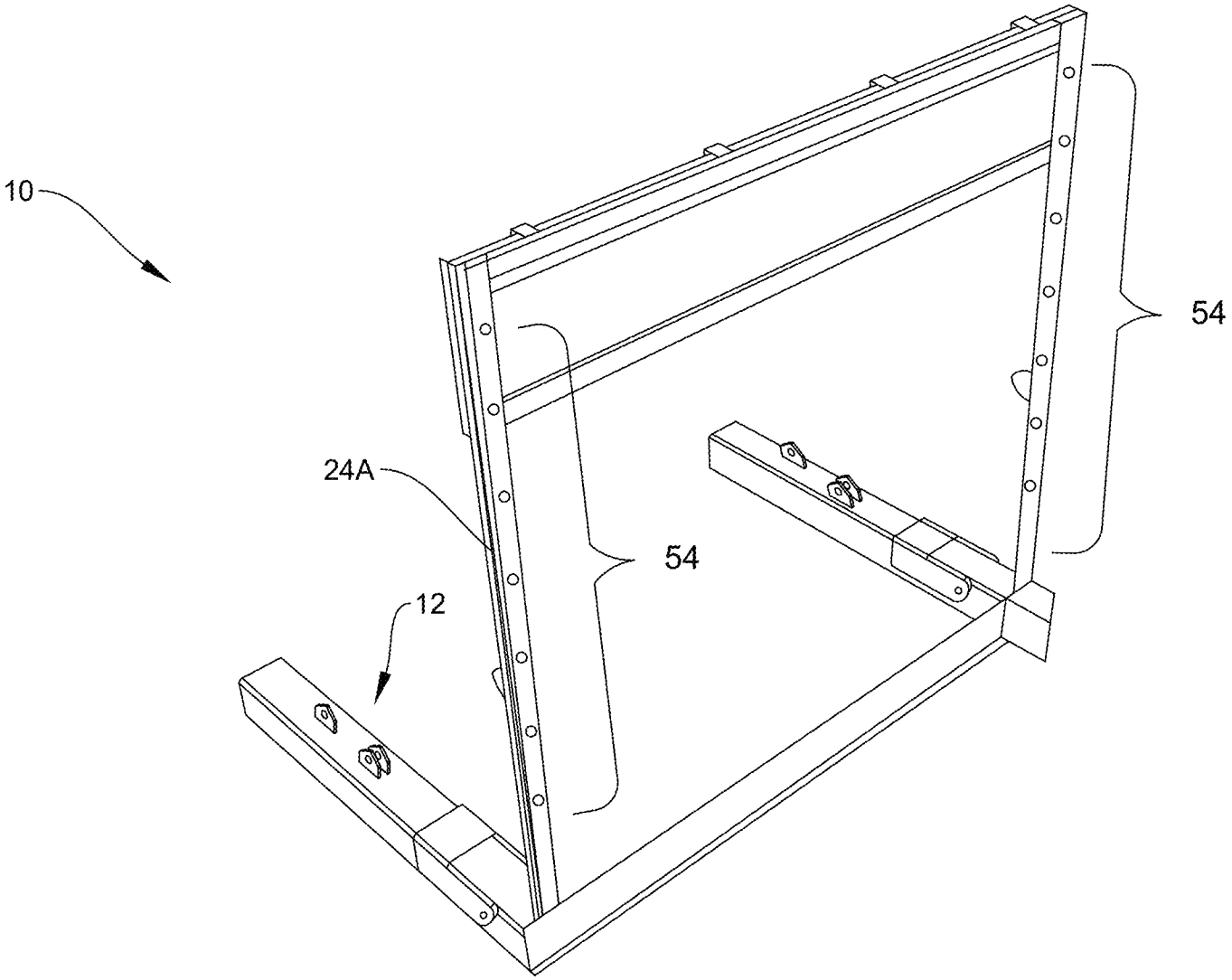
FIG. 11 is another perspective sectional view of the height adjustable obstacle wall of FIG. 9 taken along section line B-B.

As illustrated with particular regard to at least FIG. 8 through FIG. 10, one or more additional lateral supports 43 may be provided which connect the columns 24. In exemplary embodiments, without limitation, multiple additional lateral supports 43A, 43B, 43C may be provided which are spaced apart vertically. These additional lateral support(s) 43 may be connected to the outer framework members 27 and may be height adjustable with, and/or form part of, the wall portion 50. These additional lateral support(s) 43 may provide mounting points for the wall panel(s) 48. The wall panels 48 may take on the appearance of bricks, wood, or the like, even if formed of another material, such as one or more polymers, though such is not required. The wall panels 48 may provide a barrier. Notably, certain components of the wall 10 are not illustrated in at least these figures (e.g., wall panels 48, top surface 52) to more clearly illustrate certain internal components.

The lateral support 42 may be configured to accommodate some or all of the wall portion 50. The wall portion 50 may comprise the outer framework members 27 and/or the additional lateral supports 43, some or all of which may form at least part of a framework for the wall portion 50. The outer framework members 27 may be configured for sliding movement within at least the columns 24. One or more wall panels 48 may be installed to the outer framework members 27 and/or the additional lateral supports 43. The wall portion 50, and particularly the wall panels 48, may provide an obstacle barrier for users of the device 10. The additional lateral supports 43 may be provided as part of the wall portion 50 which extend between the first and second columns 24A, 24B, for example, such as to provide an interior framework for the wall portion 50 and/or the wall panels 48.

A top surface 52 may be provided at an upper portion of the wall portion 50. In exemplary embodiments, without limitation, a series of supports 53 may extend from (e.g., an uppermost one of) the additional lateral supports 43 to support the top surface 52. The supports 53 may have a longitudinal axis which extends at least substantially perpendicular (e.g., within 20%) to a longitudinal axis of the additional lateral support 43 to which it is attached.

The top surface 52 may be part of the wall portion 50. Preferably, the top surface 52 extends laterally beyond the wall panels 48, such as to provide a surface for moving, gripping, combinations thereof, or the like. The wall portion 50 may comprise at least the outer framework members 27, the additional lateral supports 43, the wall panels 48, and/or the top surface 52 for example, without limitation.

The columns 24 may each comprise interior channels 29 configured to accommodate a respective one of the outer framework members 27. Preferably, interior facing surfaces of the channels 29 are open through the columns 24 to accommodate the wall panels 48 of the wall portion 50 extending therethrough and to the outer framework members 27. Apertures 54 may be spaced apart along the columns 24, such as at least the outer framework members 27 thereof, though they may also be provided at the columns 24. The lateral support 42 may comprise apertures. In this fashion, pin(s) 43 or other fasteners may be selectively extended through the lateral support 42, each into a respective one of the apertures 54 of the columns 24, respectively, to secure the wall portion 50 at a variable height.

The wall portion 50 may define an interior and/or exterior framework with wall panels 48 on either or both sides thereof. The lateral support 42 may comprise cross supports and/or wall panels 48 on either or both sides of the device 10. As further described herein, the lateral support 42, such as including the wall panels 48 thereof, may be stationary while the wall portion 50, such as the wall panels 48 thereof, may be height adjustment.

Apertures 56 may be provided at a lower portion of the wall portion 50, such as for accommodating lifting handles 58. As illustrated with particular regard to at least FIG. 3, the lifting handles 58 may be inserted through the apertures 56 and the wall portion 50, such as to manually adjust a height of the wall portion 50 (e.g., up or down). The wall portion 50 may be secured at such various heights. An example of the wall portion 50 secured at an elevated position is provided with particular regard to FIG. 4. When lifted, a space 51 between a bottom of the wall panel(s) 48, within columns 24 and above the base 12 may be open and unobstructed. This may raise a height of the top surface 52, such as for more difficult climbing and/or create an opening 51 for a person to crawl through, for example.

Preferably, the lifting handles 58 comprise the pins 43, rods, other pins, or other items which may be passed through the wall portion 50 such that they may be handed on both sides of the wall portion 50. This may facilitate a two-user adjustment to the wall portion 50 height.

Figure 5:
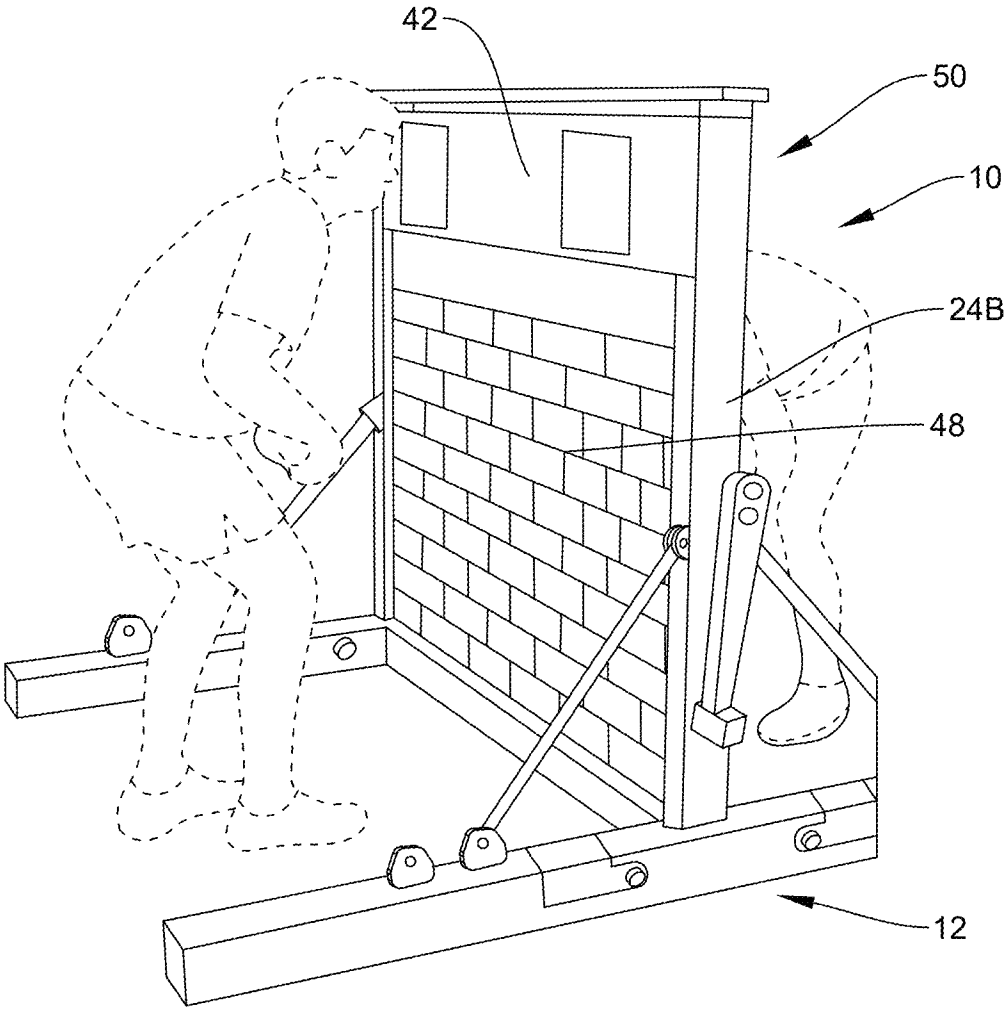
FIG. 5 is a perspective view of the height adjustable obstacle wall of FIG. 1 with the wall portion at an exemplary minimum height.

As illustrated with particular regard to at least FIG. 5, the wall portion 50 may be lowered to provide a barrier. Preferably, the wall 10 is transported in such a lowered configuration.

Figure 12:
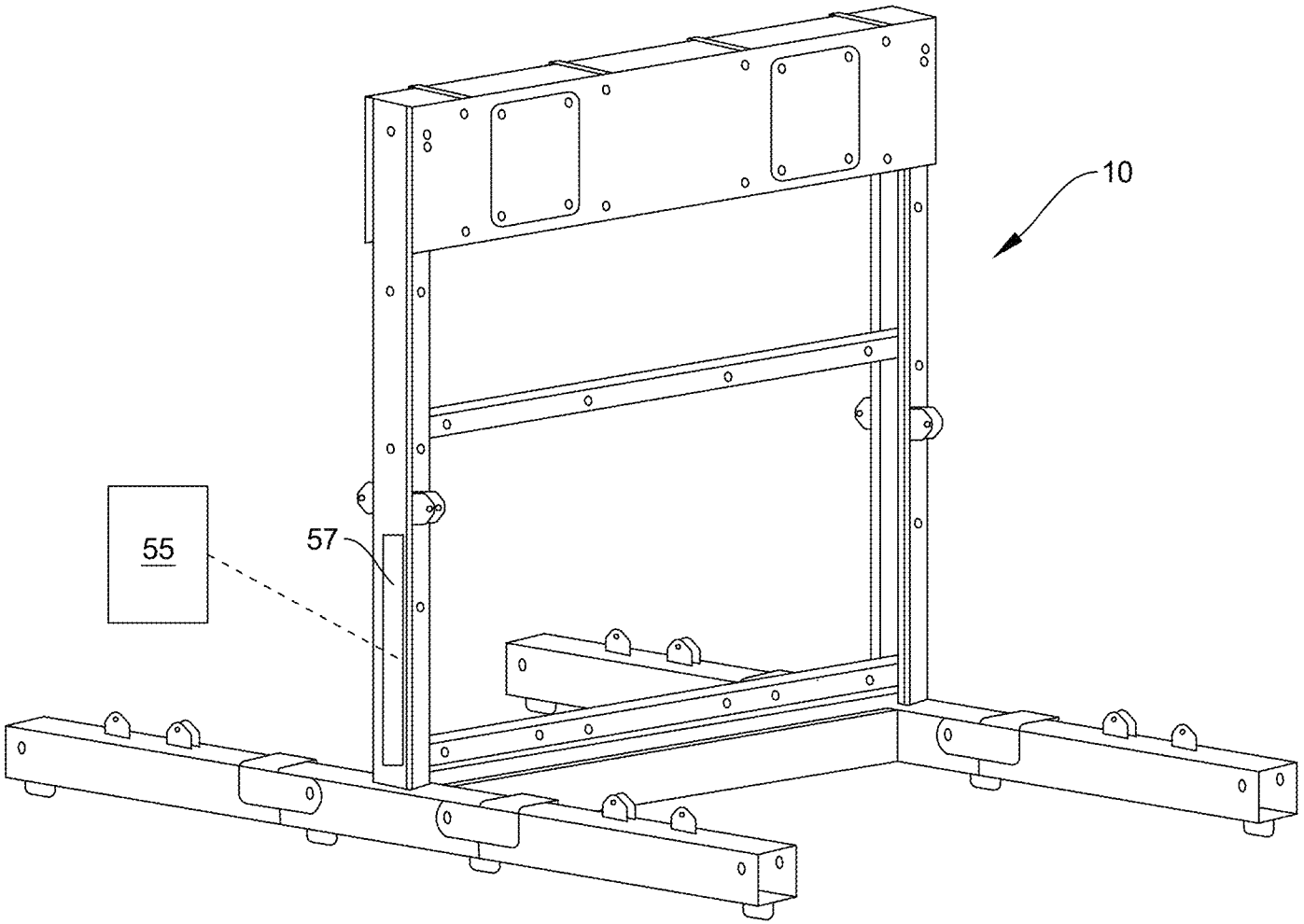
FIG. 12 is a perspective view of another exemplary embodiment of the height adjustable obstacle wall.

As illustrated with particular regard to FIG. 12, while manual adjustment is sometimes shown and/or described herein, the wall 10 may comprise, or be associated with, one or more mechanized adjustment devices 57. The mechanized adjustment devices 57 may provide at least partially automated movement, mechanical advantages, at least partial securement, and/or guiding for manual and/or at least partially automated movement. The mechanized adjustment devices 57 may include, for example without limitation, one or motors (e.g., linear actuators), gas springs, pneumatic device, hydraulic cylinders, combinations thereof, or the like. The mechanized adjustment devices 57 may alternatively, or additionally, include one or more of internal brakes, gas springs, springs, counterweights, pulleys, cranks, drive shafts, gears (e.g., rack and pinion), threaded rods, combinations thereof, or the like, such as to at least partially control height adjustment (e.g., arrest downward and/or upward motion), either in manual or automatic adjustment.

Such mechanized adjustment devices 57 may be controlled electronically at one or more controller 55. Such controller(s) 55 may comprise one or more of: wired or wireless remote, control panel installed at the device 10, remote device (e.g., smartphone, computer, sever, etc.) and/or installed or internet accessible application, combinations thereof, or the like. For example, without limitation, such motorized equipment may be installed at least partially within the columns 24 for moving the outer framework members 27 vertically. Regardless, the height of the wall portion 50 may be vertically translated, such as with regard to a ground surface where the device 10 is located, the base 12, the lateral support 42, and/or the columns 24.

The wall 10 may be electronically controlled and/or programmed (e.g., for automatic action), such as by way of the controller 55, such as by way of one or more software programs local to and/or remote from the wall, to operate automatically. For example, without limitation, the wall 10 may be programmed to move up, down, and/or to various heights at certain time intervals. Multiple walls 10 may be commonly controlled and/or programmed for automatic action in this fashion. Such movement may be made by way of the motorized equipment and/or electronic equipment. Sensors may be employed, such as at or within the columns 24, to ensure that the space 51 is unoccupied when moving the wall portion 50 downward, for example.

A variety of accessories may optionally be provided for use with the device 10. Such accessories may include, for example without limitation, a chin up bar 60, barbell end receiver 62, landing pad 64, weighted ropes 65, grab handles, medicine balls, weight sacks, belt squat attachment, dip bar attachment, d-ring attachment, skid plate attachments to push the wall as a sled, a doorway and/or barrier for breaching, tunnel extension for crawling, other custom attachments requested by a customer, combinations thereof, or the like. For example, without limitation, police or other law enforcement may use the wall as a mobile barrier, such as in combination with a bast shield/blanket draped thereover. The chin up bar 60 may comprise protrusions configured for instalment within the apertures 54 of the wall portion 50, such as when the wall portion 50 is raised. The wall panels 48 may comprise cutouts 66 configured to accommodate portions of the chin up bar 60. Various exercises may be performed at the chin up bar 60 when installed. Ropes, grab handles, combinations thereof, or the like may be installed to the chin up bar 60 to facilitate performance of various exercises. Ropes, grab handles, springs, resistance tubes, combinations thereof, or the like may be temporarily secured to various components of the device 10, such as to facilitate various exercises.

One or more barbell end receivers 62 may be installed to portions of the base 12, such as the arms 16 when unfolded. These may accommodate the ends of standard and/or Olympic size barbells and facilitate pivoting movement of the same, such as for performance of various exercises.

Figure 6:
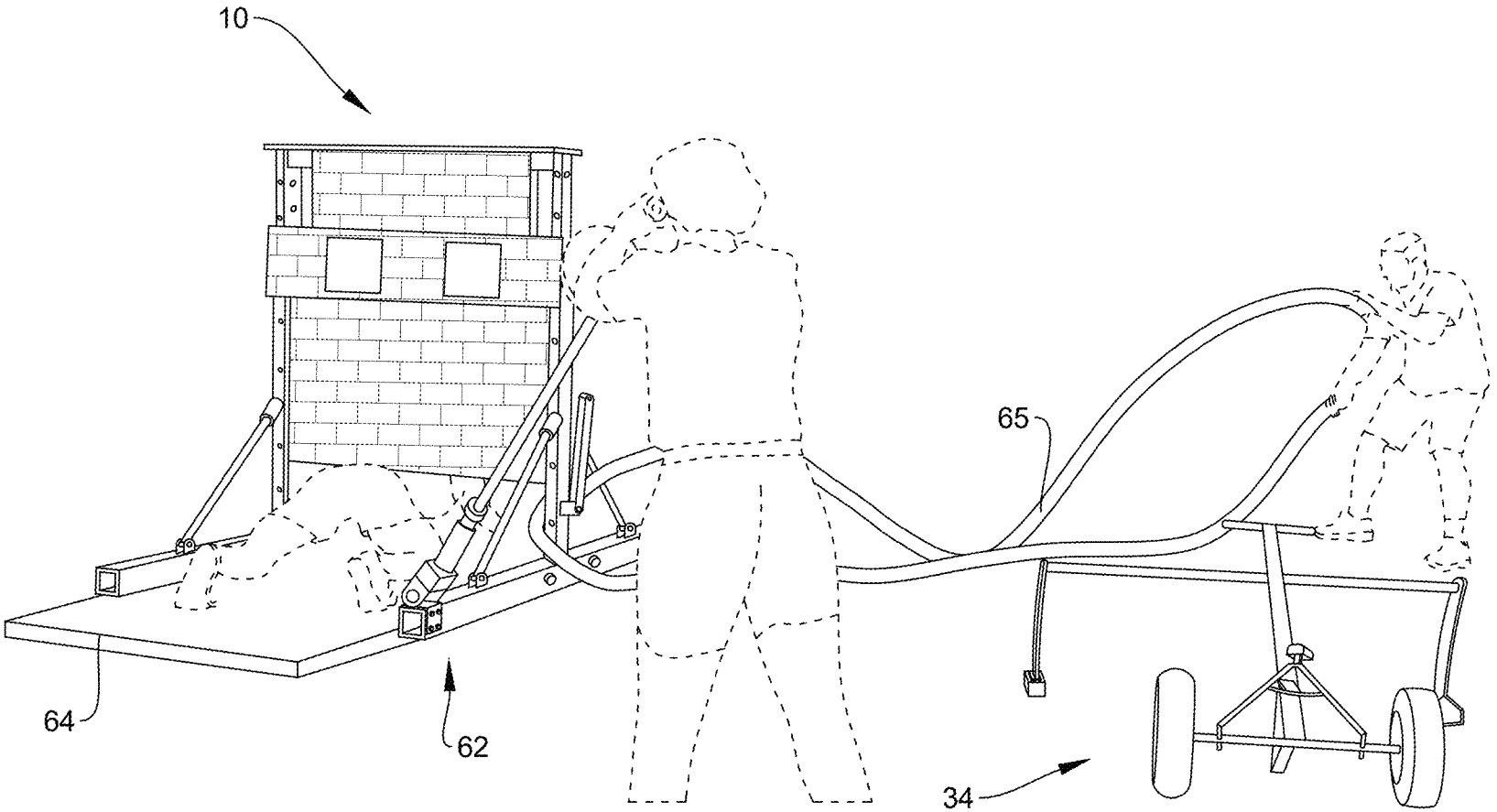
FIG. 6 is a perspective view of the height adjustable obstacle wall of FIG. 1 in exemplary use.
Figure 7:
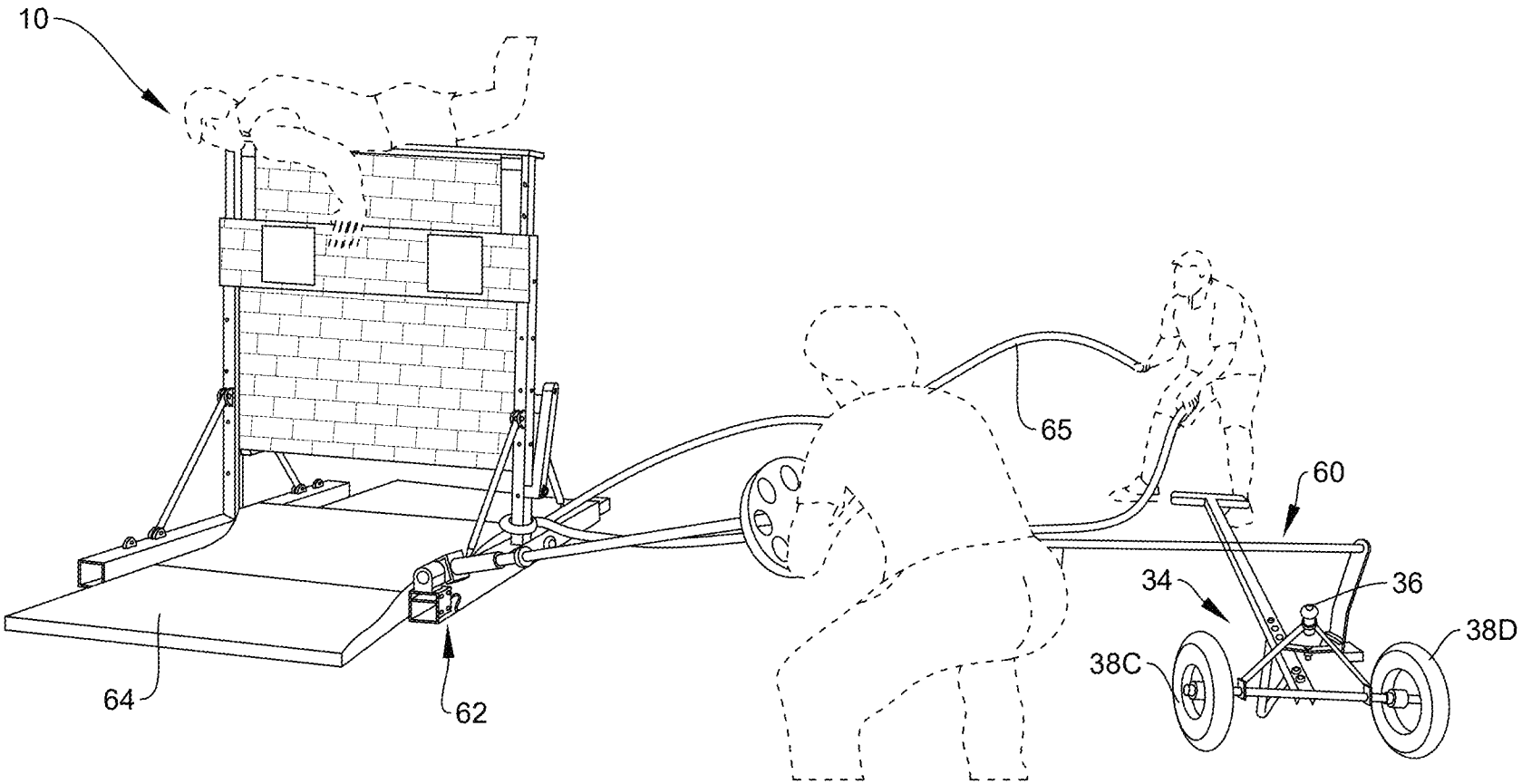
FIG. 7 is a perspective view of the height adjustable obstacle wall of FIG. 1 in exemplary use.

FIG. 6 and FIG. 7 illustrate the device 10 in exemplary use. A wide variety of exercises may be performed with the device 10. These may include muscle ups over the wall portion 50 at various heights, crawling below the raised wall portion 50, throwing objects at or over the wall portion 50 at various heights, combinations thereof, or the like. Landing pad(s) 64 may be installed at either or both sides of the wall portion 50 and/or over the lengthwise extending member 18 of the base 12, such as when the wall portion 50 is raised and provides a gap there below. The landing pads(s) 64 may facilitate softer landings and/or provide cushion when a user is moving (e.g., crawling) below the wall portion 50, for example. These exercises are provided by way of example and are not intended to be limiting.

In exemplary embodiments, without limitation, the base 12 may primarily comprise metal, such as but not limited to steel or steel alloy tubing of generally square or rectangular shape, such as for strength and durability. The wall panels 48 may comprise one or more polymers, wood, or the like, for example, for weight reduction and durability. The device 10 may be configured for indoor and/or outdoor installation and use. The device 10 is preferably located on relatively even ground but may be able to accommodate rugged surfaces, such as grassy outdoor areas, such as by way of the adjustable struts 28. Optionally, adjustable feet may alternatively or additionally be provided.

Alternatively, or additionally, the wall 10 may be utilized for a barrier for shooting ranges, simulation of tactical training scenarios such as clearing a room, blast barrier mount, or other tactical training uses. Multiple persons may utilize the wall 10 at one time creating a circuit style training apparatus that may be used for large groups (e.g., 3+ individuals, without limitation).

Any embodiment of the present invention may include any of the features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention.

Certain operations described herein may be performed by one or more electronic devices. Each electronic device may comprise one or more processors, electronic storage devices, executable software instructions, combinations thereof, and the like configured to perform the operations described herein. The electronic devices may be general purpose computers or specialized computing devices. The electronic devices may comprise personal computers, smartphones, tablets, databases, servers, or the like. The electronic connections and transmissions described herein may be accomplished by one or more wired or wireless connectively components (e.g., routers, modems, ethernet cables, fiber optic cable, telephone cables, signal repeaters, and the like) and/or networks (e.g., internets, intranets, cellular networks, the world wide web, local area networks, and the like). The computerized hardware, software, components, systems, steps, methods, and/or processes described herein may serve to improve the speed of the computerized hardware, software, systems, steps, methods, and/or processes described herein. The electronic devices, including but not necessarily limited to the electronic storage devices, databases, controllers, or the like, may comprise and/or be configured to hold solely non-transitory signals.

What is claimed is:

1. An adjustable obstacle wall apparatus, said apparatus comprising:

a base comprising a first portion for resting on a ground surface and columns extending primarily upward from the first portion; and a wall portion being substantially rigid and comprising one or more wall panels and outer framework members, wherein said wall portion is height adjustable along said columns relative to the base, and wherein vertical translation of the wall portion upward results in a gap between the first portion of the base and a lower portion of the wall portion.

2. The apparatus of claim 1 wherein:

the first portion of the base comprises a lengthwise extending member and widthwise extending members provided at a first end and a second end of the lengthwise extending member, respectively;

the columns comprise a first column positioned at the first end of the lengthwise extending member and a second column positioned at the second end of the lengthwise extending member;

the outer framework members comprise a first outer framework member at least partially disposed within the first column and a second outer framework member at least partially disposed within the second column, wherein the one or more wall panels are mounted to the first and second outer framework members; and the outer framework members are slidably disposed within the columns for vertical translation of the one or more wall panels.

3. The apparatus of claim 2 further comprising:

apertures spaced apart along each of the first and second outer framework members;

a lateral support extending between the columns, where the lateral support is located above, and spaced apart from, the first portion of the base, wherein said lateral support comprises apertures which are each positioned for selective alignment with a respective one of the apertures of the first and second outer framework members respectively; and pins, each insertable through one of the apertures of the lateral support into an aligned one of the apertures of a respective one of the first and second outer framework members to secure the wall portion at a height above the first portion of the base.

4. The apparatus of claim 3 wherein:

the first column and the second column each comprise square or rectangular tubing with an interior facing channel;

the first and second outer framework members comprise square or rectangular tubing of a size small enough to fit within the square or rectangular tubing of the first and second column, respectively; and the one or more wall panels comprises a first wall panel and a second wall panel, each extending through the interior facing channels of the first and second columns.

5. The apparatus of claim 3 further comprising:

apertures located in a lower portion of the wall portion; and grab handles for extension through the apertures in the lower portion of the wall portion so as to be accessible on both sides of the wall portion.

6. The apparatus of claim 1 wherein:

the first portion of the base comprises a fixed portion and arms movably attached to the fixed portion for folding movement;

when the apparatus is in a use configuration, the arms are unfolded and aligned with the fixed portion; and the arms are folded upward and respectively extend along the columns when the apparatus is in a storage configuration or a transportation configuration.

7. The apparatus of claim 6 further comprising:

struts; and attachment points provided at the arms and the columns, wherein the struts are removably attached to attachment points at the arms and the columns when the apparatus is in the use configuration, and wherein the struts are removed and stored when the apparatus is in the storage configuration or the transportation configuration.

8. The apparatus of claim 7 wherein:

the first portion of the base comprises an "H" shape;

the columns rise vertically from the fixed portion;

the wall portion extends between the columns; and the wall portion is configured for sliding movement within the columns to provide the height adjustability.

9. The apparatus of claim 7 further comprising:

a hitch arm moveably secured to one of said columns, said hitch arm comprise a hitch receiver, wherein the hitch arm is folded downward to extend outward from said one of said columns when the apparatus is in the transportation configuration;

a hand dolly comprising a hitch ball for attachment to said hitch receiver when the apparatus is in the transportation configuration; and wheels removably attachable to said first portion of said base, wherein said wheels are attached to said first portion of said base when the apparatus is in the storage configuration or the transportation configuration.

10. The apparatus of claim 1 wherein:

the wall portion comprises an interior framework, wherein the one or more wall panels are attached to said interior framework, and a top surface extending laterally beyond the one or more wall panels and the interior framework;

the wall portion is temporarily securable at a number of different heights relative to said base; and raising the wall portion above the base results in a gap below the wall portion and above the base.

11. The apparatus of claim 1 further comprising:

a chin up bar removably attachable to said wall portion.

12. The apparatus of claim 11 wherein:

the chin up bar is removably attachable to said wall portion at least in part by insertion of pins at said chin up bar to spaced apart apertures at each of said outer framework members of said wall portion; and the one or more wall panels comprise cutouts interior to said outer framework members to accommodate portions of the chin up bar.

13. The apparatus of claim 1 further comprising:

a pivoting barbell end holder removably attachable to the base.

14. A method of using an adjustable obstacle wall apparatus, said method comprising:

providing the adjustable obstacle wall apparatus, said apparatus comprising:

a base comprising a fixed portion and columns extending upward from the fixed portion; and a wall portion being substantially rigid and extending between the columns sliding the wall portion upward along the columns to a first height to create a gap below the wall portion and above the base;

securing the wall portion at the first height;

performing certain training exercises while the wall portion is secured at the first height;

sliding the wall portion downward along the columns to a second height to eliminate the gap; and performing other certain training exercises while the wall portion is secured at the second height.

15. The method of claim 14 further comprising:

attaching struts to attachment points at the columns and arms of the base;

placing the apparatus in a storage configuration or a transportation configuration comprising:

disconnecting the struts from the attachment points;

moving arms of the base relative to a fixed portion of the base such that said arms are folded upward;

attaching wheels to the fixed portion of the base;

folding a hitch arm secured to said columns downward;

connecting a hitch ball of a hand dolly to a hitch receiver at said hitch arm;

levering the hand dolly to raise the apparatus;

transporting the apparatus in the storage configuration or the transportation configuration to a different location.

16. The method of claim 15 further comprising:

placing the apparatus in a use configuration at the different location comprising:

levering the dolly to lower the apparatus;

disconnecting the hitch ball of the hand dolly from the hitch receiver at said hitch arm;

folding the hitch arm secured to said columns upward;

removing the wheels from the base;

moving the arms of the base relative to the fixed portion of the base such that said arms are folded downward to extend along a ground surface; and connecting the struts to the attachment points at the arms and the columns.

17. The method of claim 14 wherein:

the certain training exercises comprise crawling through the gap; and the other certain training exercises comprise muscle ups over a top surface of the wall portion.

18. The method of claim 14 wherein:

the wall portion comprises at least one wall panel and outer framework members;

the at least one wall panel is mounted to the outer framework members; and each of the outer framework members are at least partially disposed within the columns for sliding movement.

19. An adjustable obstacle wall apparatus, said apparatus comprising:

a base comprising a first portion for resting on a ground surface and having an "H" shape comprising a fixed portion forming a central portion of said "H" shape and four foldable arms, each extending from a respective end of the fixed portion;

columns extending vertically upward from the first portion of the base;

a wall portion comprising outer framework members at least partially disposed within the columns for sliding movement therein to provide height adjustability of said wall portion relative to said columns, forward and rear wall panels which extend through interior facing through channels of the columns, and apertures regularly spaced along each of the outer framework members;

a lateral support extending between the columns, wherein the lateral support is located above, and spaced apart from, the first portion of the base;

pins extendable through apertures in the lateral support and into an aligned one of the apertures in each of the outer framework members when the wall portion is adjusted to a given height to temporarily secure the wall portion at the given height, thereby adjusting a size of a gap between a lower portion of the wall portion and an upper portion of the base;

struts removably and respectively attachable to attachment points at the foldable arms and the columns when the apparatus is in a use configuration, wherein the struts are removed and stored when the apparatus is in a storage configuration or a transportation configuration, wherein said foldable arms are folded downward when the apparatus is in the use configuration, and wherein said foldable arms are folded upward when the apparatus is in the storage configuration or the transportation configuration;

a hitch arm secured to one of said columns and comprising a hitch receiver, wherein the hitch arm is folded downward to extend primarily outward from said one of said columns when the apparatus is in the storage configuration or the transportation configuration, and wherein the hitch arm is folded upward to extend primarily along said one of said columns when the apparatus is in the use configuration;

a hand dolly comprising a hitch ball for selective attachment to said hitch receiver; and wheels removably attachable to said fixed portion of said base, wherein said wheels are attached to said fixed portion of said base when the apparatus is in the storage configuration or the transportation configuration.

* * * * *